US007506651B2

(12) United States Patent
Anonsen

(10) Patent No.: US 7,506,651 B2
(45) Date of Patent: Mar. 24, 2009

(54) REUSABLE CUSTOMIZABLE BREATHING APPARATUS MOUTHPIECE WITH BITEWINGS

(76) Inventor: James Anonsen, 61-3616 Kawaihae Rd., Kawaihae, HI (US) 96743

( * ) Notice: Subject to any disclaimer, the term of this patent is extended or adjusted under 35 U.S.C. 154(b) by 0 days.

(21) Appl. No.: 11/403,080

(22) Filed: Apr. 12, 2006

(65) Prior Publication Data

US 2006/0207611 A1 Sep. 21, 2006

Related U.S. Application Data

(63) Continuation-in-part of application No. 11/084,572, filed on Mar. 18, 2005, now abandoned.

(51) Int. Cl.

| | |
|---|---|
| ***A61F 5/37*** | (2006.01) |
| ***A61C 5/14*** | (2006.01) |
| ***A61C 3/00*** | (2006.01) |
| ***A61C 19/00*** | (2006.01) |
| ***A61C 9/00*** | (2006.01) |

(52) U.S. Cl. ..... 128/859; 128/846; 128/860; 128/861; 128/862; 433/6; 433/34; 433/36; 433/37; 602/902

(58) Field of Classification Search ..... 128/846, 128/859–862; 602/902; 433/6, 34, 36, 37
See application file for complete search history.

(56) References Cited

U.S. PATENT DOCUMENTS

| | | | |
|---|---|---|---|
| 3,107,667 | A | 10/1963 | Moore |
| 3,603,306 | A | 9/1971 | Bonin |
| 3,844,281 | A | 10/1974 | Shamlian |
| 3,929,548 | A | 12/1975 | Shamlian |
| 4,136,689 | A | 1/1979 | Shamlian |

(Continued)

FOREIGN PATENT DOCUMENTS

| | | | |
|---|---|---|---|
| GB | 8611411 | A | 6/1986 |
| WO | WO9822186 | A1 | 5/1998 |

OTHER PUBLICATIONS

Laurie Barclay., "Scuba Mouthpiece Can Cause Jaw and Dental Problems", WebMD, my.webmd.com/Article/18/1676_52711.htm.

(Continued)

*Primary Examiner*—Patricia Bianco
*Assistant Examiner*—Tarla Patel
(74) *Attorney, Agent, or Firm*—Guerry L. Grune; ePatentManager

(57) ABSTRACT

A customizable and reusable mouthpiece for diving use having a passageway-forming front member extending from a proximal in-mouth end to a distal outside end and a U-shaped formable back member is described. The back member provides a hollow cavity portion located in the bitewing section that may be partially filled with a gel-like or other suitable substance configured to provide custom moldability at substantially all points of contact between the mouthpiece and the teeth such that the mouthpiece is securely gripped by the teeth. The mouthpiece requires pressure relief channels so that air or fluids may enter into and be forced out of the hollow cavity providing a bellows-like action that provides a means for the bitewing and materials of composition to return to essentially its original shape. Reusability of the mouthpiece, more specifically the bitewings is directly related to the choice and combination of materials, dimensioning and processing.

14 Claims, 3 Drawing Sheets

U.S. PATENT DOCUMENTS

| | | | | |
|---|---|---|---|---|
| 4,664,109 | A | 5/1987 | Rasocha | |
| 4,862,903 | A | 9/1989 | Campbell | |
| 4,986,283 | A * | 1/1991 | Tepper | 128/859 |
| 5,031,611 | A | 7/1991 | Moles | |
| 5,062,422 | A | 11/1991 | Kinkade | |
| 5,203,324 | A | 4/1993 | Kinkade | |
| 5,282,462 | A | 2/1994 | Kudo | |
| 5,305,741 | A | 4/1994 | Moles | |
| 5,620,011 | A * | 4/1997 | Flowers | 128/859 |
| 5,638,811 | A | 6/1997 | David | |
| 5,645,420 | A * | 7/1997 | Bergersen | 433/6 |
| 5,701,885 | A | 12/1997 | Hale | |
| 5,865,170 | A | 2/1999 | Moles | |
| 6,079,411 | A | 6/2000 | Garofalo | |
| 6,257,239 | B1 | 7/2001 | Kittelsen et al. | |
| 6,491,036 | B2 | 12/2002 | Cook | |
| 6,536,424 | B2 | 3/2003 | Fitton | |
| 6,539,943 | B1 | 4/2003 | Kittelsen et al. | |
| 6,553,996 | B2 | 4/2003 | Kittelsen et al. | |
| 6,581,604 | B2 | 6/2003 | Cook | |
| 6,626,180 | B1 | 9/2003 | Kittelsen et al. | |
| 6,675,806 | B2 | 1/2004 | Kittelsen et al. | |
| 6,691,710 | B2 | 2/2004 | Kittelsen et al. | |
| 6,735,149 | B2 | 5/2004 | Pierot | |
| 6,820,623 | B2 | 11/2004 | Cook | |
| 2003/0152888 | A1 * | 8/2003 | Sun et al. | 433/167 |
| 2005/0037311 | A1 * | 2/2005 | Bergersen | 433/6 |

OTHER PUBLICATIONS

Gall et. al., "Internal stress storage in shape memory polymer nanocomposites", Applied Physics Letters, vol. 85, No. 2, Jul. 12, 2004.

Laurie Barclay., "Scuba Mouthpiece Can Cause Jaw and Dental Problems", WebMD, Apr. 4, 2001.

Gall, et al., "Internal stress storage in shape memory polymer nanocomposites", Applied Physics Letters, vol. 85, No. 2, Jul. 12, 2004, May 11, 2004.

* cited by examiner

REUSABLE CUSTOMIZABLE BREATHING APPARATUS MOUTHPIECE WITH BITEWINGS

CLAIM TO PRIORITY

This application is a continuation-in-part and claims the benefit under U.S. code 35 U.S.C. 120 of commonly assigned U.S. application Ser. No. 11/084,572, titled "REUSABLE CUSTOMIZABLE BREATHING APPARATUS MOUTHPIECE WITH BITEWINGS", filed Mar. 18, 2005 now abandoned, the entire disclosure of which is herein fully incorporated by reference.

FIELD OF INVENTION

This invention is related generally to scuba-diving mouthpieces and, more particularly, to mouthpieces that are reusable and customizable for multiple and/or individual divers.

BACKGROUND OF THE INVENTION

Scuba-diving mouthpieces of various kinds have been known and used for many years. The great majority of such mouthpieces are not customizable for individual divers, but some customizable scuba-diving mouthpieces have been known or used. Examples of customized or customizable scuba-diving mouthpieces are those shown in U.S. Pat. No. 3,107,667 (Moore), U.S. Pat. No. 3,844,281 (Shamlian), U.S. Pat. No. 3,929,548 (Shamlian), and U.S. Pat. No. 4,136,689 (Shamlian), and U.S. Pat. No. 5,305,741 (Moles) U.S. Pat. No. 5,031,611 (Moles). These U.S. patents are herein incorporated by reference.

Despite advances in recent years, there are many problems and shortcomings with scuba-diving mouthpieces as known in the prior art. Perhaps the most common problem relates to mouth fatigue experienced by scuba divers. Mouthpieces are typically held in place by means of the diver's bite on retaining members which project inwardly from a lip-engaging portion to positions between the upper and lower teeth. This not only places significant pressures on small portions of the diver's teeth, i.e. the portions engaging the retaining members, but also the constant muscle pressure needed for secure retention of such mouthpieces can cause significant muscle strain and aching of the jaw and other portions of the head connected to the jaw bone. The fatigue is exacerbated when a recreational scuba diver dives for an extended period of time without the benefits of an ergonomic or customizable mouthpiece.

Customizing the surfaces of such retaining members to match the tooth surfaces, as in the above-mentioned patents to Shamlian—U.S. Pat. No. 3,844,281 and U.S. Pat. No. 3,929,548 ameliorates the problem, however, the improvement is very limited because of the fact that contact with the inwardly-projecting retaining members is limited to only a few teeth.

Greater tooth contact is possible with scuba-diving mouthpieces such as the customized mouthpiece disclosed in the above-mentioned patent to Moore (U.S. Pat. No. 3,107,667). The tooth-engaging portions in such a device extend well back along the line of the molars on either side of the mouth. Such extension provides a greater lever arm, thereby reducing the pressure necessary to hold the mouthpiece in the mouth. Because of this, mouth fatigue should be reduced. However, the process used to manufacture such a mouthpiece is extremely complex, requiring steps such as making wax replicas of the maxillary and mandibular impressions of the mouth, mounting such replicas in the appropriate relative positions of the partly-opened mouth, carving, uniting tube and tooth impression portions, plaster forming, introducing vulcanizable rubber, separating plaster from formed rubber, and other steps.

The complexity of this manufacturing process rules out quick preparation, such as would be required in a diving equipment shop. Furthermore, the process can produce mouthpieces that are less than satisfactory in comfort. In some cases, this is because the relative positions of the relative maxillary and mandibular portions may not be natural. In other cases, this may be because the relative positions are not sufficiently closed. The problem of unnatural jaw position placement is accentuated for the 20% or so of the population whose jaws are developed well away from normal patterns. In each case, improper relative placement, even in customized scuba-diving mouthpieces, exacerbates the usual problems of jaw fatigue.

The problems of jaw fatigue and joint strain during long use are accompanied by a related problem—a tendency toward an inability by the diver to easily maintain the mouthpiece in the proper orientation, particularly when pressures are applied to the mouthpiece from outside the diver's mouth. Constant musculo-skeletal force applied to a device or load promotes fatigue and eventual failure to hold the device. Unwanted pressures on the mouthpiece grip may come about from water currents (relative to the diver), contacts made with other divers or diving apparatus, as well as a variety of other causes. It is essential, of course that the diver's mouthpiece, which is the sole source of air, remains in place and remains safe and usable. Thus, the concern about pressure interfering with the grip of the diver on his or her mouthpiece is a safety issue that requires further attention and is a continued source of research and development efforts.

Some of the problems with current scuba-diver mouthpieces can be understood better by reviewing the sections of the mouth, jaw, and teeth of a typical person that are in use when a mouthpiece is employed during diving activities. The jawbone is a lengthy angled member that pivots with respect to the skull about the temporo-mandibular joint well back from the mouth with respect to the jawbone. This joint is typically positioned considerably above the level of the teeth and well behind the position of the teeth. From this joint, the jaw has a generally downwardly and slightly forwardly extending portion which extends generally to a position rearwardly spaced from the teeth, and a more forwardly, but still downwardly, extending portion which carries the teeth of the lower jaw and extends forwardly beneath the upper jaw. The angle between the two portions of the lower jaw is referred to herein as the "jaw angle."

Opening and closing muscle tissue masses are secured to the jaw at positions forward of the jaw joint, but well rearward of the teeth. The muscles secured to the lower jaw create a lever arm which extends from the jaw joint all the way to the point of contact pressure of the lower jaw with either the upper jaw or with whatever is being bitten and exists between the lower and upper jaw area. Mouthpieces, including that of the present invention, are essentially bitten to ensure proper insertion—at least upon original insertion into the mouth.

When using a typical diving mouthpiece, or a customized diving mouthpiece such as those shown in the aforementioned Shamlian patents (U.S. Pat. No. 3,844,281 and U.S. Pat. No. 3,929,548), the lever arm of the lower jaw extends from the jaw joint all the way forward to the position of the eye teeth where the mouthpiece is gripped by biting between the diver's teeth.

Two separate problems are created when the mouthpiece contact occurs in this manner at the forward position in the mouth:

First, since the distance from the center of muscle effort is long, a significant increase in muscle force is necessary to stabilize and retain the mouthpiece. This is what causes the muscles to quickly fatigue and often causes pain. The initial pain is often followed by jaw aches and headaches. A second and related problem of this long lever arm is created when standard mouthpieces, or customized mouthpieces of the Shamlian type, in that there is a severe increase in pressure within the jaw joint, which resides well back in the head or skull portion of the user.

If the contact location is extended to the back of the mouth, the lever arm is shortened and advantages are achieved, including a reduction in the muscle force necessary to hold the mouthpiece and a reduction in the corresponding jaw pressure. Lengthening the mouthpiece retention piece to allow contact at a more rearward position in the mouth creates a shorter, and thus more favorable, lever arm. This resists torque from movement of the diver's regulator. That is, a better grip can be maintained with less exertion during the gripping when "biting" the mouthpiece.

Another unresolved problem that remains is that the extension of the posterior bite pieces have been difficult to use or unworkable due to the variability in the jaw alignment of different individuals. Only a completely customized bite portion would compensate for this problem. The variability in the angle between the teeth of the upper and lower jaws continues to exist as a major problem for mouthpieces. Such variability is caused by differences in the aforementioned lower jaw angle and also by the angle of the upper jaw with respect to the lower jaw.

Another major problem with previous customizable mouthpieces is based upon the fact that extreme variability exists with front teeth (incisors) in that they generally have a unique vertical direction relative to the back teeth for each individual and when these teeth extend downwardly more than an average distance, they tend to partially cover the air intake of the mouthpiece. When the diver bites on the bite portions of the mouthpiece, this creates a partial reduction and increased turbulence of the air flow. The diver tends to experience "starving" for air in this circumstance—an unacceptable safety hazard.

Mouthpieces of the prior art include a lower front flange of the mouthpiece at a position vertical and directly below the upper flange. However, when the typical jaw opens it follows a variable path that is both downward and backward with respect to a reference point. At a jaw opening position of 4-6 mm (open), which is the average mouth opening for insertion of a diving mouthpiece, the lower jaw typically must come forward to grip the bite portions and seal against the lower front flange. This tends to cause significant muscle strain, and places the jaw joint in an unnatural position complete with a heavy load on the joint.

Known customizable scuba-diving mouthpieces have been unable to easily and properly accommodate a wide variety of mouth and teeth configurations. It would be desirable to have a customizable scuba-diving mouthpiece that can provide excellent and easy diver engagement for a wide variety of divers. In addition, it would be extremely useful to provide a mouthpiece which could be used multiple times by different divers that would accommodate each individual diver's unique jaw and teeth configuration. Such an arrangement would be of particular importance in the dive rental business.

There remain still additional problems related to creation of a completely customizable scuba-diving mouthpiece. Broad-reaching customizability causes problems in maintaining strength and integrity in the mouthpiece at points of pressure and torque. For example, materials, which are both readily formable and of acceptable flexibility may be weakened by torque applied at certain points. More specifically, a torque applied on the mouthpiece can cause tearing of such material unless mouthpiece construction and design allow for minimization or elimination of the risk of damage. Furthermore, customizing critical surfaces of such a mouthpiece must be carried out without degrading the structural integrity and strength of the mouthpiece.

Still another concern with customized scuba-diving mouthpieces of the prior art is that such mouthpieces do not very well accommodate what is referred to by divers as "buddy-breathing." Buddy-breathing involves use of a single mouthpiece by more than one diver, as may be necessary when the oxygen supply of one diver is low. In such situations, the mouthpiece is handed back and forth for alternating use by two divers. Customized mouthpieces of the prior art are not well suited for this practice. This is particularly true for mouthpieces having extended tooth engagement along either side of the diver's mouth.

Problems in manufacture can arise in the final customizing steps, that is, in fitting a customizable scuba-diving mouthpiece for a particular diver. While it is desirable to have a large area of customized tooth mouthpiece engagement, heating of the mouthpiece could lead to unacceptable deformation in areas not to be engaged by the mouth, for example, areas to engage the air conduit of a second-stage regulator. It would be desirable to provide a customizable mouthpiece not susceptible to such problems.

Another concern that has not been addressed in the prior art is the inability of the bitewings to function properly due to complete filling of the hollow bitewings or "bladders" or bladder cavity with gel-like substances. It has been determined, through extensive manufacturing and testing, that the presence of pressure relief channels on for both bitewing bladder cavities are required in order for bitewings to function properly. In this case, functioning properly is defined as conforming to the pressure and associated bite of the diver (user) into or onto the upper and lower surfaces of the bitewing thereby deforming the bitewing while allowing for conforming to the shape of the teeth that contact the bitewing. The pressure relief channels during compression allow air and or fluid (water, etc.) to be forced out of the bladder cavity (which is connected to the biteplate bladder cavity) and thereby allows for full or partial compression depending on the amount of gel or other similar substance originally within the bladder cavity. As the pressure and/or subsequent bite is released, the pressure relief channels essentially act as a bellows in that they allow air or other fluids to enter back into the cavities. Fully filled bladder cavities allow for at best extremely minimal compression and at worst no compression whatsoever in the presence of normal jaw pressures, thus defeating the purpose of filling the cavity with any substance to provide comfort and relieve jaw fatigue.

In order to create a full dental impression during or after bitedown, such as is possible with the present invention, the biteplate bladder cavity cannot be filled to capacity or overfilled, and actually may not require any filling whatsoever. It has been determined that in the case of an empty bladder cavity, the advantageous form, fit, and thus reduction of early jaw fatigue is comparable to that of an identical designed mouthpiece and biteplates that are partially filled. In both cases (unfilled and partially filled bladder cavities) the design requires the pressure relief channels connected to the bladder such that comfort is provided due to compression and relaxation of the biteplate cavities (normally fabricated from thermoplastics such as liquid silicone rubber and the like).

While there have been a number of efforts to make improved customizable scuba-diving mouthpieces, there has remained a clear need for significant improvements in the field of customizable scuba-diving mouthpieces that are both customizable and reusable specifically with regard to the dive rental and equipment sales business.

DESCRIPTION OF PRIOR ART

U.S. Pat. No. 3,107,667, issued to Moore describes a customizable mouthpiece manufactured by taking dental impressions in wax and creating an enamel or other hard material in order to form a proper impression in a hot rubber composition. When the rubber is cooled the dental impression remains and is a custom fit for the user.

U.S. Pat. No. 3,929,548 issued to Shamlian describes a method of customizing the retaining portion of a mouthpiece of an underwater breathing apparatus to the bite of the individual user by heating a blank of thermoplastic material until it is at a temperature sufficient to render the blank thermoplastic. The mouthpiece is then placed in the mouth of the user while in a thermoplastic state and the user bites down on the thermoplastic material to cause the blank to flow and to form an impression of the users bite. The impressed blank is cooled whereby the retainer portion of the mouthpiece is customized to the bite of the user.

PCT Publication WO9822186A1 issued to Stier describes an emergency breathing device with a resilient mouthpiece and a valved body for receiving a hose coupling and a seal whereby gas pressure in the hose closed the seal. Squeezing pressure from opposite sides of the mouthpiece exerts a force on the valve actuator, opening the seal and allowing a breathable gas to flow from the hose into the mouthpiece.

U.S. Pat. No. 6,536,424 issued to Fitton, describes a mouthpiece with a continuous wall with anterior and posterior sections. The anterior and posterior sections have an inner surface that conforms to an anatomy of a user's upper and lower dental arches and retaining wings substantially conforming to the users mouth.

U.S. Pat. No. 3,603,306 issued to Bonin, describes a snorkel for use by divers or the like having a mouthpiece with an orifice for a breathing tube that is offset to the side allowing for the tube to be curved substantially along the users face to minimize friction and drag.

U.S. Pat. No. 3,844,281 issued to Shamlian, describes a mouthpiece to be used in combination with underwater breathing apparatus that supplies breathable gas to a subject through a conduit whereby the mouthpiece is a pliable flange means for insertion between the lips and the outer frontal surface of the teeth of the user. A pair of tabs located on opposite sides of the breathing hole that engage only the several top and bottom teeth behind the front teeth whereby the retaining means of the mouthpiece is customized to the bite of the individual user. The mouthpiece is fabricated of a material that is less plastic than the customized portion of the mouthpiece.

U.S. Pat. No. 4,862,903 issued to Campbell, describes a mouthpiece for a second stage breathing gas regulator with a portion having a curved upper lip flange adapted generally for conforming to the interior region of a user's mouth between the upper teeth and the user's upper lips and a curved lower lip flange adapted generally for conforming to the interior region of a user's mouth between the user's lower teeth and the inner lower lips respectively. The mouthpiece has an upper interior web anatomically shaped for contact with at least part of the inside surfaces of at least the frontal upper teeth of a user's palate U.S. Pat. No. 5,062,422 issued to Kinkade, describes a mouthpiece oriented for an overbite with wing members having a taper such that the one end that is farther from the orifice is smaller than the second end nearer the orifice.

U.S. Pat. No. 5,203,324 issued to Kinkade, describes a mouthpiece oriented for an overbite with wing members having a taper such that the one end that is farther from the orifice is smaller than the second end nearer the orifice and where the wing members having a laterally extending surface bounded on either side thereof by substantially vertical curved walls for contacting the lateral surfaces of the user's cuspids and bicuspids.

U.S. Pat. No. 5,701,885 issued to Hale, describes a pressure equalizing scuba diver mouthpiece with a fluid equalizing passageway such that when a user changes contact position on the mouthpiece the fluid flows from one bitewing to the other so that the pressure is equalized.

U.S. Pat. No. 4,664,109 issued to Rasocha, describes a mouthpiece with a pliable lip flange for insertion between the lips and the outer frontal surface of the teeth And a plurality of lugs connected to and extending from said lip flange on opposite sides of said hole for disposition between the biting surfaces of the teeth.

Also described is a multiplicity of individual, spaced apart, upstanding, resilient projections on the upper and lower sides of the lugs with the distal ends of the projections providing a multiplicity of spaced apart planar surfaces for abutment with the biting surfaces of said teeth.

U.S. Pat. No. 6,820,623 issued to Cook, describes a customizable athletic force absorbing mouthguard having a u-shaped base with upstanding labial and lingual walls forming a channel for the teeth of a user comprised of low-density polyethylene with tactifier resin to improve durability, retention and fit of the mouthguard.

U.S. Pat. No. 6,626,180 Kittlesen, et. al., describes a composite performance enhancing and force absorbing mouthguard having a U-shaped base with upstanding labial and lingual walls forming a channel with a softenable, customizable wall and base material to custom fit the mouth of a user and forming the labial and lingual walls and the base. Two elastomer traction pads located posteriorly below the base and a pair of disconnected anterior elastomer braces forms a gap therebetween to permit adjustment of the braces to conform to irregularities of anterior teeth and to custom fit the channel to the mouth of a user.

U.S. Pat. No. 6,691,710 issued to Kittlesen, et.al. describes a composite performance enhancing and force absorbing mouthguard having a U-shaped base with upstanding labial and lingual walls forming a channel with a nonsoftenable, flexible framework of posterior occlusal plates in the base. Two hard durable bite wedges are located posteriorly along the occlusal plates with each wedge being thicker posteriorly than anteriorly. On top of the two bite wedges are elastomer traction pads and a pair of disconnected anterior impact braces. Each brace permits adjustment of the braces to conform to irregularities of anterior teeth of the user a softenable, customizable wall and channel to fit the channel of the mouthguard to the mouth of a user.

U.S. Pat. No. 6,675,806 issued to Kittlesen, et. al., describes a composite performance enhancing and force absorbing mouthguard with a softenable, customizable wall and base material to custom fit the mouth of a user.

U.S. Pat. No. 6,553,996 issued to Kittlesen, et.al., describes a dental appliance for a mouth having antimicrobial characteristics comprising an antimicrobial additive in an occlusal pad to be placed on teeth within the mouth.

U.S. Pat. No. 6,539,943 issued to Kittlesen, et.al., describes a dental appliance with a pair of posterior occlusal pads and a framework extending from the pads upwardly and inwardly forming an arch with each pad having a bite plate of hard very durable material and a softenable, impressionable material encapsulating the bite plate, the framework and substantially the pads.

U.S. Pat. No. 6,581,604 issued to Cook, describes a customizable athletic force absorbing mouthguard having a u-shaped base with upstanding labial and lingual walls forming a channel for the teeth of a user comprised of low-density polyethylene, further comprising an antimicrobial additive in the low-density polyethylene.

U.S. Pat. No. 6,257,239 issued to Kittlesen, et.al. describes a performance enhancing and force absorbing dental appliance with a pair of posterior occlusal pads and an arch connecting the pads; and an anti-microbial additive in the pads and arch.

U.S. Pat. No. 6,491,036 to Cook describes a customizable athletic force absorbing mouthguard having a u-shaped base with upstanding labial and lingual walls forming a channel for the teeth of a user comprised of low-density polyethylene with a nucleating agent to securely shrink and fit the mouthguard.

U.S. Pat. No. 5,282,462 issued to Kudo describes a mouthpiece of a regulator to supply air from a cylinder into a cavum oris of a diver with the mouthpiece having a tube which abuts against an outer side of the cavum oris of the diver when the mouthpiece is worn by the diver. The tube is connected with a demand regulator unit and a pair of teeth grips extending from said tube toward molar teeth in the cavum oris of the diver so as to be bitten and held by the molar teeth. The teeth grips are integrally provided with connecting rods which are inserted into the tube of the mouthpiece with each connecting rod connected to the tube so as to be integral with said tube. The connecting rods are slightly longer than the tube such that each of the teeth grips is to the outside of the tube. Biting portions are laminated against the molar teeth that are vertically abutted and connected to the connecting rods.

U.S. Pat. No. 5,638,811 issued to David describes an anatomical mouthpiece in two sections that includes a first section having a connection piece that is connectable to a gas source. A second section two vertical vestibules matching an anatomical shape of the mouth of the user. The second section is made of biocompatible and flexible thermoplastic material which is formable at standard body temperature in a mouth area.

U.S. Pat. No. 5,865,170 issued to Moles describes a scuba-diving mouthpiece for customizing for a particular diver including means for gripping a diver's teeth having: (1) a front member extending from a proximal in-mouth end to a distal outside end and forming a horizontal passageway from the distal end to the proximal end; and (2) a U-shaped formable back member having (a) a forward middle portion secured to the front member proximal end in position for formable custom moldable engagement with the diver's forward teeth and (b) a pair of leg portions extending from the middle portion rearwardly to pass between the diver's molars and terminate at the rear of the mouth, each leg portion having inner and outer upstanding flanges and a substantially horizontal bite portion extending therebetween, the bite portion having formable custom-moldable upper and lower surfaces and the flanges having upwardly-extending and downwardly-extending flange portions with upper and lower edges, respectively, and inside surfaces spaced for formable custom-moldable engagement with opposite side surfaces of the user's teeth, said outer flanges extending forward to merge with the forward middle portion, the improvement comprising:* the inner upstanding flange of each leg portion rearwardly terminating substantially lateral to the diver's first molar;* the outer flange of each leg portion forming a concave outside surface on the leg portion, the concave surface having a nadir line substantially along and adjacent to the horizontal bite portion;* the outer flange of each leg portion rearwardly terminating forward of the diver's second molar* the horizontal bite portion extending beyond the diver's second molar;* the bite portion having, at positions adjacent to the inner flange, a first width; and* the bite portion having, at positions beginning immediately rearward of the inner flange, a second width which is no greater than the first width.

U.S. Pat. No. 5,305,741 to Moles, describe a scuba-diving mouthpiece for customizing for a particular diver including a U-shaped formable, custom moldable moldable upper and lower surfaces and having flanges upwardly and downwardly extending. These flange portions engage with opposite side surfaces of the user's teeth with the outer flanges extending forward to merge with the forward middle portion.

U.S. Pat. No. 5,031,611 to Moles describes a scuba-diving mouthpiece with the bite members having the diver's dental impressions therein to form a major customized tooth engagement providing intimate tooth contact to the full extent of the diver's molars while the diver's mouth is in a relaxed, partially-opened position, thereby eliminating diver fatigue.

U.S. Pat. No. 6,735,149 issued to Pierot, describe a mouthpiece for a snorkel or diving regulator, adapted to fit in the mouth of a diver or swimmer having at least one transducer buzzer for transmitting the vibrations of said membrane towards teeth of the diver or swimmer, as an aid to underwater communications.

U.S. Pat. No. 4,136,689 issued to Shamlian describes a retainer for the mouthpiece of an underwater breathing apparatus for gripping between the user's upper and lower teeth essentially only on either opposite side of the central front teeth with the upper and lower teeth of the user spaced apart to facilitate breathing through the breathing tube. The retainer is being made of a material which is thermoplastic at an elevated temperature compatible with use within the mouth of the user and which is moldable while in a thermoplastic state by the bite of the user so as to flow to form an impression of the bite of the user in the material upon cooling thereof, whereby each retainer of the mouthpiece can be customized to the bite of the individual user.

U.S. Pat. No. 3,844,281 issued to Shamlian describes a mouthpiece for insertion between the lips and the outer frontal surface of the teeth of the user with a breathing hole for passing gas in a substantially unobstructed flow path into the mouth and through the teeth of the subject. The flange being held in the users mouth only the several top and bottom teeth behind the front teeth.

U.S. Pat. No. 6,079,411 issued to Garofalo describes a mouthpiece with orthodontic tooth grip for divers comprising two hollow bodies made of very thin and very elastic material and filled with a very fluid material.

U.S. Pat. No. 5,620,011 issued to Flowers describes an improved mouthpiece apparatus wherein the tooth contact area provides a slit into a hollow chamber for the insertion of a flavorful gel substance for the divers enjoyment.

SUMMARY OF INVENTION

This invention is an improvement in scuba-diving and snorkeling mouthpieces and, more specifically, an improved reusable and customizable scuba-diving mouthpiece of the type that includes a front breathing hole for regulator attachment and rear portions customizable for a particular diver's jaw and teeth patterns. The invention provides for a bitewing and mouthpiece arrangement that is customizable for any users' dental imprints and essentially returns to its original state and shape when not in use. The invention also involves the use of improved materials to ensure dental imprint customizable mouthpieces that are reusable. The dental imprint essentially disappears after use by an individual so that it may be used again by either another individual (with a different dental imprint) or by the same individual. The invention overcomes many of the problems and shortcomings noted in the prior art and described in detail in the Background of the Invention section.

The customizable scuba-diving, snorkeling, for breathing, mouthpiece of the present invention includes providing a known customizable mouthpiece with a distal end that includes a distal orifice for allowing air from an air source through a mouthpiece channel and through a proximal orifice into the user's mouth. The mouthpiece also includes lateral wings that contain outwardly a smooth surface for contact with the user's inner cheeks, a vertical flange that contacts the lateral surface of the user's gums and teeth and a horizontal bite plane that extends medially between the user's teeth. Hollow cavities are formed in the mouthpiece during the molding process that readily accept an elastomeric gel-like substance.

The customizable mouthpiece may be comprised of an elastomeric silicon, such as liquid silicon rubber (LSR) that has the proper FDA approval, thermoplastic material such as ethylene vinyl acetate (EVA) and ethylene vinyl acetate blends which are soft and malleable at room temperature and thus customizably malleable in the user's mouth at body or slightly elevated above body temperatures (95-105 F). The temperature at which the bitewings accept the dental imprints of the user must be low enough to avoid any pain to the user during the in-mouth customizing steps. Certain FDA-approved polyvinyl chloride materials have been used in the past and may support the underlying portions supporting the EVA or EVA blends or other acceptable materials for the mouthpiece and/or mouthpiece/bitewing assembly.

The most preferred embodiment of this invention includes an LSR material, flexible at body temperature, that allows the bitewing surface to return to an "as manufactured" shape when removed from the user's mouth. This is known as an elastic memory of the thermoplastic. In addition, the LSR mouthpiece contains hollow portions within the bitewings that are partially filled with an elastomeric gel-like substance of which the hollow cavity portions have access to the outside environment through a channel that may be used as an elastomeric gel injection site. An integral flap or valve may be used to prevent loss of gel through the pressure relief channels. This feature is shown in FIGS. 2A and 2B of the present invention. An additional benefit of this invention is that the material consistency allows the user to reform the customizable insert in the user's mouth, before and even during the diving session to alleviate soreness due to mouth position stasis. A biocide may be added to the polymer or applied to the surface of the mouthpiece to ensure microbial growth does not occur in the polymer or suitable composite forming the mouthpiece and/or bitewings.

Garofalo teaches a high elasticity material and filling the hollow bodies with a very fluid material whereas the present invention teaches toward a slow to recover, low elastic material and partially filling the cavities and allowing the cavities to be open to the environment in order to properly take the shape of the users dental impression.

Flowers does not teach toward customization of the mouthpiece to conform to the users dental impression.

A material for the mouthpiece that has been shown to be effective is a blend of ELVAX 260, an ethylene vinyl acetate produced by DuPont having 85 Shore A hardness and a Vicat softening point of 115 degree F.; and ELVAX 250, an ethylene vinyl acetate having 80 Shore A hardness and a Vicat softening point of 108 degree. F. The resulting mouthpiece is customizable when at an acceptable temperature for in-mouth molding, which is well under 120 degree F. Of course, any of the materials to accomplish the mouthpiece must be acceptable to the FDA for intraoral use. The materials for use in the present invention require pliability at or about 96.8 F for the upper section of the mouthpiece. Reusability without heating back to 120 F requires that the formulation of an ELVAX-like material be precise and allow for essentially instant memory relaxation to return to its original shape. Cellular or foamed versions as well as co-polymers, blends, and composites as well as nanocomposites that include inorganics such as clays as well as fullerenes and nanotubes of fullerene based derivatives of compositions may be required to ensure complete memory or at least full plastic recovery so that reusability can be achieved.

Recent advances in the use of nanometer-scale SiC ceramic reinforcements embedded in an amorphous active shape memory polymer matrix as described by Gall, et. al. in an article entitled "Internal Stress Storage in Shape Memory Polymer Nanocomposites", App. Phys. Letters, Vol. 85, No. 2, Jul. 12, 2004, may also be useful in providing the necessary recovery of the elastic strain. The elastic strain is stored in the nanoparticles during deformation and released during subsequent heating. The use of such nanoparticles in combination with the LSR or ELVAX-like materials described above would lower the energy requirements to provide for full shape recovery of the device.

The specific aspects of these advances are fully described from excerpts of the article by Gall, et. al and have particular relevance with regard to this invention; Shape memory polymers possess the capacity to recover large strains on the order of 50%-400% by the application of heat. The ability of shape memory polymers to spontaneously recover large strains in restricted environments has been exploited in numerous applications, such as heat shrink tubing, deployable aerospace structures, Microsystems, and biomedical devices. Although the recoverable strain limits in-shape memory polymers are orders of magnitude higher than shape memory alloys or piezoelectric materials, their ability to generate "recovery" stress under strain constraint is limited by their relatively lower stiffness. However, the stiffness and recovery stress of shape memory polymers can be substantially increased, at the expense of recoverable strain, by the inclusion of hard ceramic reinforcements. In the present study, we examine the storage and release of internal stress in nanometer-scale SiC ceramic reinforcements embedded in an amorphous active shape memory polymer matrix. Although the shape memory effect is not inherent to the ceramic nanoparticles, the present results demonstrate that elastic strain is stored in the nanoparticles during deformation, and released during subsequent heating.

"The thermomechanical response of shape memory polymers is defined by four critical temperatures. The glass transition temperature $T_g$ is the reference point for thermomechanical deformation and recovery. The deformation temperature $T_d$ is the temperature at which a polymer is deformed into a temporary shape. The initial deformation $T_d$ can occur above or well below $T_g$ depending on the desired recovery response.[3] The storage temperature $T_s$ is less than or equal to $T_d$ and constitutes the temperature at which the temporary shape is stable over time. After deformation at $T_d$, the material is typically cooled to $T_s$ with varying degrees of stress/strain constraint, ranging from no constraint to full constraint. In some instances, such as the present study, $T_d$ is equal to $T_s$ and cooling is not necessary after deformation, analogous to the shape memory effect in metals. The recovery temperature, $T_r$, represents the temperature at which the material recovers its original shape during heating. Recovery can be accomplished isothermally by heating to a fixed $T_r$ and then holding, or by continued heating, up to and past $T_r$."

The bitewing hollow cavities may be of different shapes and sizes.

Most preferably the bitewing hollow cavities or bladders will be partially filled to allow for the user dental impression to impose a conformable shape in the bitewing. Partially filling the hollow cavities allows for the user to provide, with the use of the conformable bitewings including the pressure relief channel, a comfortable separation between the upper and lower teeth with a low amount of pressure, thereby alleviating jaw fatigue. Injecting the gel-like material into the hollow cavity can be performed with the mouthpiece hollow cavity in either a horizontal position or vertical position, depending on fill amounts and the need to evenly or preferentially fill the cavities.

It is preferred that the channels which act as pressure relief channels may also be used for injecting the gel-like material. These channels will remain open between the hollow cavity and the outer surface of the mouthpiece to allow for an exchange of air or fluids between the empty portion of the hollow cavity and the outside of the mouthpiece. This exchange of fluid or air allows for compression and relief of the bitewing in order to enable a full dental impression and shape recovery of the bitewing contact surface. The channels have been designed such that they will not become blocked with the gel-like substances used for filling so that air/fluids may continue to pass into and out of the cavities/bladders.

Alternatively, the pressure relief channels may include one or more grooves molded into a portion of the channel that will allow for a customizable disc with a rigid outer portion and a flexible, diaphragmatic center portion that may be inserted into the groove to act as a barrier to prevent the gel from escaping the hollow bitewing cavity, yet still allow for displacement of air, gel or fluid in the channel. If the mouthpiece is underwater during use, the water or any fluid could fill a portion of the channel, but not allow for penetration into the hollow cavity of the bitewings. The customizable disc may be inserted or not inserted upon manufacture, installed with a kit and thereby installed or removed by the user.

In addition, the pressure relief channels can be connected to an outer walled section of the mouthpiece that is a "balloon-like" pouch in appearance and is capable of collecting an excess of gel if there is such a need or may hold excess gel if such a need arises. These pouches may exist in an area that is toward the distal end of the mouthpiece (near the regulator) such that these pouches can never be placed within the mouth portion of the mouthpiece user.

The distal end of the mouthpiece can vary significantly within the scope of this invention, both in the degree and/or rigidity of its distal orifice. It is important that the initial form of the mouthpiece be maintained while bitewings provide formability to facilitate customizing and reusability as previously described.

The mouthpiece, separate from the injectable elastomeric gel, is preferably comprised of a material or composite materials or nanocomposite materials that are not formable at relatively low temperatures (during use in the water). Among other things, this serves to avoid constriction of the channel and other changes which might ruin the initial mouthpiece form or interfere with its function. It is also important that the surface of distal orifice properly engages the regulator, and that the surface of channel retains its shape during the molding process.

Examples of suitable materials for the mouthpiece include various blends of LSR, styrenic TPE (thermoplastic elastomer) and ethylene vinyl acetate (EVA); various blends of styrenic TPE and polypropylene; and semi-rigid PVC. Suitable materials for the mouthpiece will preferably be acceptable to the Food and Drug Administration (FDA) for intraoral use. Use of nanocomposites such as discussed above and below by Gall, et. al. can be incorporated into all materials described in this specification.

An example of a polymeric blend that would meet the FDA requirements and also provide for plastic memory is a styrenic TPE and ethylene vinyl acetate would include 95% KRATON, a styrenic TPE from Shell Chemical, Houston, Tex., and 5% of ELVAX 550, an ethylene vinyl acetate from DuPont, Wilmington, Del. Adjusting the relative amounts of KRATON and ELVAX 550 tends to adjust the hardness of mouthpiece. Reusability without heating back to 120 F requires that the formulation of an ELVAX-like material be precise and allow for essentially instant memory relaxation to return to its original shape. Cellular or foamed versions as well as co-polymers, blends, and composites as well as nanocomposites that include inorganics such as clays as well as fullerenes and nanotubes of fullerene based derivatives of compositions may be required to ensure complete memory or at least full plastic recovery so that reusability can be achieved. Recent advances in the use of nanometer-scale SiC ceramic reinforcements embedded in an amorphous active shape memory polymer matrix as described by Gall, et. al. in an article entitled "Internal Stress Storage in Shape Memory Polymer Nanocomposites", App. Phys. Letters, Vol. 85, No. 2, Jul. 12, 2004, may also be useful in providing the necessary recovery of the elastic strain. The elastic strain is stored in the nanoparticles during deformation and released during subsequent heating. The use of such nanoparticles (700 nm for the Silicon Carbide used by Gall, et. al.) in combination with the ELVAX-like materials described above would lower the energy requirements to provide for full shape recovery of the device.

A preferred blend of styrenic TPE and polypropylene has 88% of KRATON and 12% of polypropylene FDA blend. Increasing the amount of KRATON in such blends tends to allow the front member of the mouthpiece to better engage the second-stage regulator.

The lateral bitewings are situated and configured to extend from the middle of the mouthpiece rearwardly to pass between the diver's molars and terminate at the rear of the mouth.

Each lateral bitewing has a vertical flange and a substantially horizontal bite plane. Each horizontal bite plane extends between its vertical flanges medially. Each horizontal bite plane has substantially constant thicknesses from front to back and side to side, such thickness preferably being at least about 1.15±0.5 mm.

The vertical flange has upwardly and downwardly-extending portions with the approximate midline being half the thickness of the horizontal bite plane. The vertical flange extends substantially along the entire U-shape of the lateral wings.

The bitewing hollow cavities may extend from approximately a user's eye-tooth contact position rearwardly to engage in contact with the user's full molar set.

The upwardly and downwardly-extending portions of vertical flanges may not appear to be flanges in the normal sense because of their abutment with the distal end of the mouthpiece, however, they are referred to as "flanges" because they are relatively thin, generally planar members that would appear to be flanges in the normal sense in the absence of distal ends and are continuations of flange structures which extend along the lateral wings to allow for tooth contact in forward positions.

The vertical flange decreases in height distally until meeting generally at the horizontal planes at the proximal end. This configuration serves to better accommodate typical mouth/tooth orientations for any user/diver.

Precise steps for formation of the mouthpiece and a description of the apparatus used for the molding steps to provide the mouthpiece will vary according to the materials used and the processing required.

After formation of customizable breathing apparatus mouthpieces by molding or other thermal forming, or pressure, or vacuum means, the mouthpieces may be easily customized for a particular user without the need for formation of any intermediate shapes and parts and without the need for extended development processes. The mouthpiece will return to its original shape (without dental impressions) by various means—preferably without any energy requirement (other than simple removal from the user's mouth). It may be necessary, based on environmental conditions present at the time, to heat the mouthpiece or merely the bitewings to slightly above the Vicat softening temperature by exposure to a warm environment, such as hot water, sunshine, or by oral insertion so that human body temperature (98-99 F) such that the user may be allowed to use his/her bite to customize (or re-customize) the tooth-engagement surfaces.

The customizable reusable mouthpiece of this invention allows for customized tooth-engagement surfaces not only between the molars, that is, along the top and bottom of the upper and lower horizontal bite plane but also along each of the outer vertical flanges.

In some preferred embodiments, the bitewing portions extend rearward beyond the upstanding flanges facilitating custom engagement between the diver's full molar set without impinging upon sensitive gum tissue in constricted areas of the mouth.

An additional aspect of this invention regarding the method for making a mouthpiece of the type described for customizing for a particular diver or user includes forming a substantially rigid member that extends from a proximal in-mouth end toward a distal outside end and forms a horizontal passageway including the formable U-shaped member that includes a core member forming the complete mouthpiece. In highly preferred methods in accordance with this invention, the configuration of the mouthpiece is as described above.

Alternate forms of the method of this invention include the mouthpiece forming step preferably including forming a substantially rigid core which extends from the proximal in-mouth end to a position short of the distal outside end and defines part of the horizontal passageway. In such cases, the subsequent molding step includes molding the remainder of the mouthpiece (the section where dental imprints occur including the cavities or bladders) onto the rigid core. This remainder of the mouthpiece can be comprised of formable material, and includes the back member and a formable front portion that covers the core and may extend beyond the core to form the distal outside end. The present invention requires that the top portion of the mouthpiece is composed of material that will deform and then "collapse" back to its original shape based on plastic or elastomeric "memory". The underlying portion of the mouthpiece (the portion facing away from the upper and lower teeth), may be composed of more conventional non-deformable materials. This allows for the use of two or more different materials providing for a single molded mouthpiece.

As already noted, one method of manufacture involves a core member that is not soft or as soft as the bitewing or biteplate section of the mouthpiece. The use of different materials for the back member and the core portion of the mouthpiece that would provide different characteristics during final customization, is an important aspect and another of the preferred embodiments of this invention.

The core member may itself be entirely comprised of a single material or, as already described, include a core of one material along with a remaining portion of another. No matter how the core is constructed, it is essential that it have the structural strength necessary for the mouthpiece to provide its connecting function with respect to the regulator used in scuba-diving.

It is useful to describe the term "formable," as applied to the mouthpiece or portions of the mouthpiece of the present invention including the bitewing sections which subsequently engage the teeth and mouth and includes in the term "reformable."

Before customization by the user by closing the jaw onto the bitewings, the mouthpiece members or portions thereof must be formed to provide a shape that accommodates this "customizing process". The customizing process itself involves forming such members or portions thereof to take the shapes necessary to allow the mouthpiece to grip the diver's teeth and surrounding mouth tissue. The present invention requires that the reformable materials revert back to their original shape within a short time period after use so that reuse can occur for the next (and successive) individual's dive.

The most preferred embodiment of this invention includes a mouthpiece comprised of an FDA approved liquid silicon rubber (LSR) or the like containing hollow cavities created inside the bitewing portions of the mouthpiece that may be filled, partially filled, or not filled (remaining hollow), with an FDA approved gel-like customizable silicone elastomer material that can change shape and adjust to pressure in temperature ranges typically found between room and body temperatures (typically 40-120 F) and that allows for the bitewings to return to an "as molded" shape when removed from the user's mouth. This feature of the hollow biteplate and gel combination can best be described as an elastic memory of the gel material in combination with the fact that the biteplate restrains the displacement caused by the user upon insertion into the mouth and thereby allows for general shape retention during compression by the user and then subsequent restoration to the original shape after release of the compression of the bite and/or upon removal from the mouth. This compression and restoration to original shape is accomplished by a "bellows-like" process in that air (or other gases or liquids) initially fill the hollow biteplate cavities or bladders. The air is then forced out through pressure relief channels as earlier described, during compression and then air is allowed back into the cavities during release for restoration. The pressure relief channels are designed so that they will not become blocked if gel or gel-like materials are used to partially fill the cavities and also so that the opening of these channels exit toward the front end of the mouthpiece, near the opening for the regulator. In this manner, if gel or other foreign material from the cavity/bladder escapes through the channel, the material will exit into either the water or the air and not into the diver's mouth and/or into the diver's throat.

An additional benefit of this customizable bitewing is that the gel-like material that fills the hollow section may be an elastomeric, thermoplastic, foamed, or any combination thereof or other composition with a consistency that allows for forming or reforming the customizable insert in the user's mouth, before, during, or after the diving session to alleviate soreness due to mouth position stasis.

The bitewing hollow cavity or bladder may be of any shape or size as determined by the formability and reformability of the interaction between elastic memory of the mouthpiece and the elastic memory of the gel material. The percentage fill of the cavity with the gel-like material, as well as the size and shape of the bitewing cavity and the length and width of each bitewing will greatly influence, deformation, comfort, feel, jaw fatigue and eventual response time (memory recapture).

The bitewing hollow cavity top and bottom wall sections may be of any thickness from 0.1 mm to 3.0 mm with a preferable thickness of 1.15±0.5 mm.

The total bitewing exterior thickness can be between 3 mm and 12 mm with a preferable thickness of ±2 mm.

The total bitewing exterior width ranges from 2 mm to 20 mm with a preferable width of 12±5 mm.

The bitewing length may be customized for each user as determined by selectively trimming the hollow cavity bitewing ends to fit the individual user.

Closure of the hollow cavity bitewing ends may be by thermal, chemical or adhesive bonding in order to ensure the sealing of the hollow cavity such that the hollow cavity may be filled with a gel-like or other suitable liquid or gaseous material either through an opening provided by the bitewing ends or through an orifice or channel provided through any portion of the mouthpiece wall that passes into the hollow cavity.

Injection of material into the hollow bitewing cavity can be achieved with the mouthpiece in a horizontal or vertical position such that the injection position determines the initial flow characteristics of the injected material and subsequently the fill characteristics of the hollow cavity. Injection may be accomplished either through the pressure relief channels or more preferably into the other end of the cavity where sealing is later accomplished.

The mouthpiece and manufacturing method of this invention solve many heretofore unresolved problems. A highly superior mouthpiece is provided which offers divers incomparable comfort, reliability, and reusability for any dive session. The mouthpiece of this invention requires little, if any, energy to allow for reuse once restoration to or near the original shape after deformation. This important feature is to ensure that a second (and successive) individual diver or the same diver on a different dive be able to use the same mouthpiece and/or mouthpiece/bitewing combination after reversion to the original shape.

DETAILED DESCRIPTION OF THE DRAWINGS

Figure 1A:
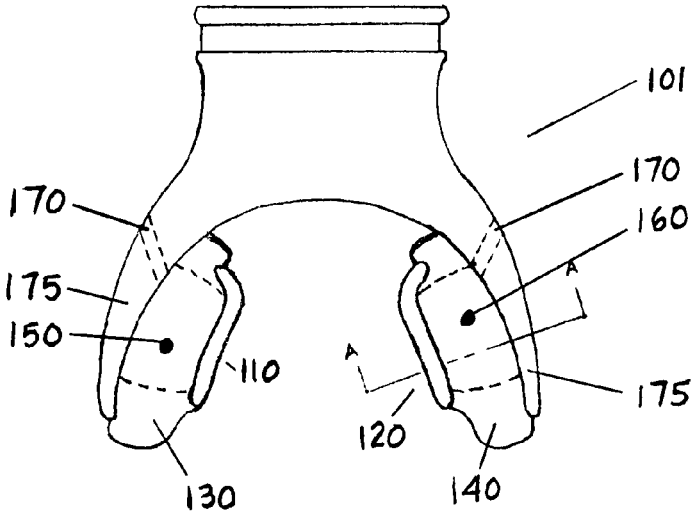
FIG. 1A is a top view of the mouthpiece with hollow cavities in the bitewings and channels provided for allowing air or fluids to enter and exit the channels. The preferred site for injection of a gel or gel-like substance can be accomplished using the channels, hollow cavities or bladders provided within the bitewings.

The mouthpiece may be comprised of a thermoplastic material such as liquid silicon rubber (LSR), which is pliable, and thus custom formable in the user's mouth at body temperatures during in-mouth use that amounts to customizing steps. Within the LSR mouthpiece are hollow cavities or bladders that are formed in the areas where the users teeth (normally the molars) will make contact with bitewings within which the hollow cavities or bladders reside. The hollow cavities are formed open to the proximal end as used by a diver via pins in the molding tool used to form the mouthpiece. Additionally, channels are formed and may be useful for injecting a gel or gel-like substance into the bitewing hollow cavity or bladder.

Upon removing the mouthpiece from a molding tool, the bitewing ends may be thermally, chemically or adhesively sealed thereby allowing only for the injection sites to be used as openings to the hollow cavities. The gel or gel-like material may subsequently injected through the injection sites to preferably partially fill the hollow cavities. It is also possible to leave the cavities empty. An insertion tool used to provide the hollow cavity is normally removed from the injection site providing a hollow cavity, which when subjected to the pressure of a users teeth and jaw allows for release of air or fluids to the outside of the cavity. This enables the hollow cavity to collapse upon the gel-like material and thereby provides comfort by conforming to the users dental impression. Release of the pressure associated with the teeth and jaws allows for the hollow cavity to refill with air or fluids (such as water in the vicinity of the dive), and the cavity may thereby return to the "as-manufactured" or pre-stressed shape. This "bellows-like" action which initially requires pressure and then allows for the release of pressure assists in providing a "boost" to the memory recovery of the thermoplastic elastomer from which the mouthpiece is custom molded (liquid silicone rubber is one such elastomer). This compression and subsequent release of the dental impression in conjunction with biteplates may take place on multiple occasions while in use within the diver's mouth, depending on the diver's proclivity for opening and closing the jaw.

Alternatively certain FDA-approved ethylene vinyl acetate, ethylene vinyl acetate blends and polyvinyl chloride materials may be used to form the mouthpiece and/or the bitewings or biteplates. Cellular or foamed versions as well as co-polymers, blends, and composites as well as nanocomposites that include inorganics such as clays as well as fullerenes and nanotubes of fullerene based derivatives of compositions may be required to ensure complete memory or at least full plastic recovery so that reusability can be achieved. Recent advances in the use of nanometer-scale SiC ceramic reinforcements embedded in an amorphous active shape memory polymer matrix as described by Gall, et. al. in an article entitled "Internal Stress Storage in Shape Memory Polymer Nanocomposites", App. Phys. Letters, Vol. 85, No. 2, Jul. 12, 2004, may also be useful in providing the necessary recovery of the elastic strain. The elastic strain is stored in the nanoparticles during deformation and released during subsequent heating or other energy application. The use of such nanoparticles in combination with other materials described above would ensure full shape recovery of the device where full shape recovery may otherwise be impossible to achieve.

The most preferred embodiment of this invention is that the mouthpiece material comprise an FDA approved LSR together with a silicone based elastomeric gel, conformable at body temperature that returns to an "as manufactured" shape when removed from the user's mouth. Additionally, it is preferred that the hollow cavity be partially filled with gel or left empty depending on the comfort and feel most preferred over successive dives by individuals.

An additional benefit of this invention is that the material consistency allows the user to reform the bitewing surface in the mouth, during the diving session to alleviate soreness due to mouth position stasis. A biocide may be added to the polymer or polymer composite or on the surface of the composite to prevent bacterial growth.

The hollow cavities may be of different shapes and sizes and may be filled with the gel-like material such that the mouthpiece is either in a horizontal position or alternatively in a vertical position.

With the customizable scuba-diving mouthpiece of the present invention, customized tooth-engagement surfaces will include not only the spacing between the molars, that is, along the top and bottom of the bitewings, but also along each of the bitewing ends.

Shown in the figures is a rendition of a typical diving mouthpiece with the features of this invention noted in the following figures.

FIG. 1A is a top view of the mouthpiece [101] with a left-side bitewing [110] and right-side bitewing [120] and a left-side top cavity bitewing end [130] and right-side top cavity bitewing end [140] a left-side hollow cavity [150] a right-side hollow cavity [160], and a preferred channel [170] that extends through the lateral wing [175] of the mouthpiece [101].

Figure 1B:
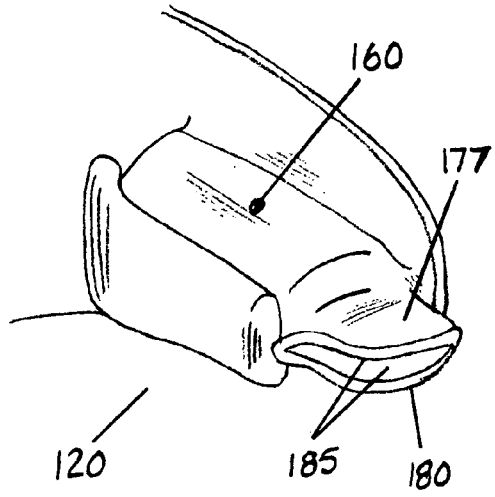
FIG. 1B is an end view of an unfilled hollow cavity or bladder within the bitewing showing the top and bottom cavity bitewing ends.

FIG. 1B is an open-end view of an unfilled right-side hollow cavity [160] in the right-side bitewing [120] including a top cavity end [177] and a bottom cavity end [180]. The top cavity end [177] and the bottom cavity end [180] comprise opposing surfaces [185] that may be thermally, chemically or adhesively sealed to form a hollow closed cavity. The top cavity end [177] and the bottom cavity end [180] lengths may be subsequently trimmed by the user for comfort fitting.

Figure 1C:
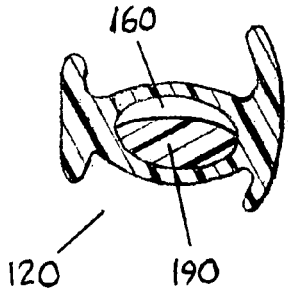
FIG. 1C is a cross section of a hollow cavity or bladder within the bitewing that is partially filled with a gel or gel-like substance.

FIG. 1C is a cross section (AA) of the right hollow cavity [160] for the right bitewing [120] and illustrated as partially filled with an elastomeric gel-like material [190].

Figure 2A:
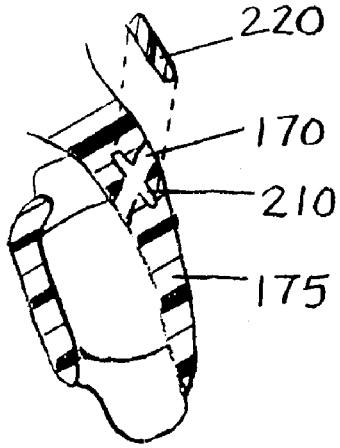
FIG. 2A is a cross section of a pressure relief channel that extends through the lateral wing and the alternative disc insertion groove.

FIG. 2A is a cross section of a pressure relief channel [170] that extends through the lateral wing [175] and the optional disc insertion groove [210] for placement of a customizable disc [220].

Figure 2B:
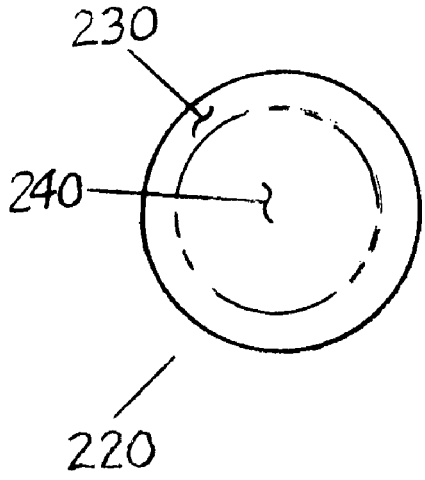
FIG. 2B is a drawing of a disc that may be placed into the disc insertion groove.

FIG. 2B is a drawing of a disc [220] wherein the disc [220] has an essentially rigid perimeter [230] transitioning to a flexible center [240]. The disc [220] may inserted in the mouthpiece during manufacture [101] or provided in kit form allowing the user to install the disc.

Figure 3:
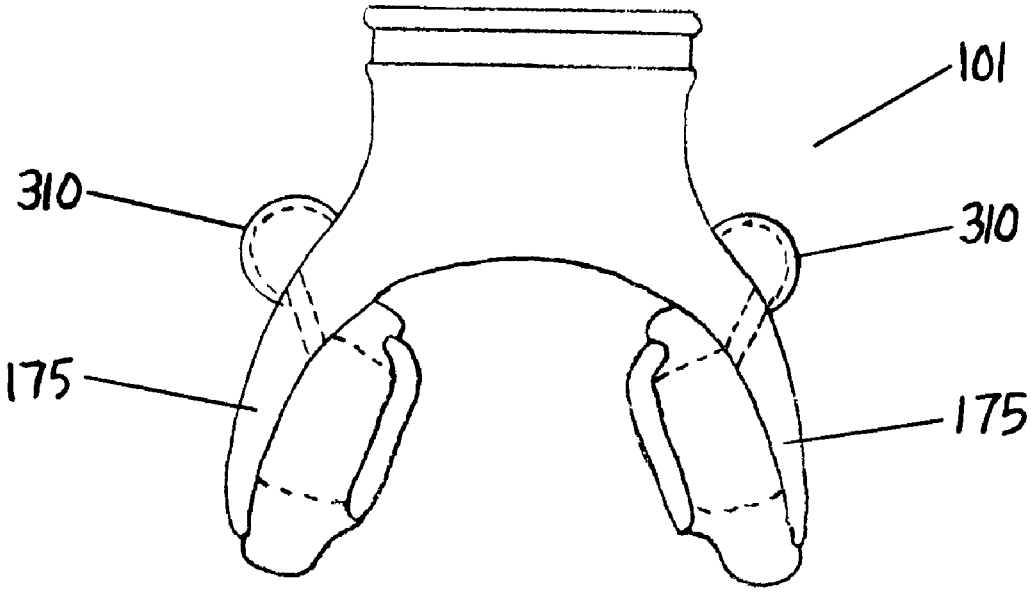
FIG. 3 is a drawing of mouthpiece with alternative "balloon-like" pouches attached to the lateral wings.

FIG. 3 is a drawing of mouthpiece [101] with alternative "balloon-like" pouches [310] attached to the lateral wing [175] toward the distal end of the mouthpiece [101]. The "balloon-like" pouches [310] may be of any manufacturable shape or configuration.

While the principles of this invention have been described in connection with specific embodiments, it should be understood clearly that these descriptions are made only by way of example and are not intended to limit the scope of the invention.

What is claimed is:

1. A reusable customizable mouthpiece wherein a core member comprises: a substantially rigid non-formable core that provides a rigid shape to said mouthpiece extending from a proximal in-mouth end toward a position short of a distal outside end and forming part of a horizontal passageway with a U-shaped member that forms said complete mouthpiece of a type with a front portion forming a breathing hole and at least one bitewing that is customizable; wherein said bitewing initially provides a formable hollow cavity, wherein said formable hollow cavity may be empty, partially, or completely filled with an elastomeric gel, and wherein said bitewing extends proximally beyond said formable hollow cavity and may form a top cavity end and a bottom cavity end that may be sealed and subsequently trimmed; and wherein a channel or channels provide access to said distal outside end the outside the users mouth that extend from said formable hollow cavity laterally toward said distal outside end from said front portion through a lateral wing toward such that said channel allows for fluid such as a gas or a liquid to flow into and out of said formable hollow cavity; wherein channels that include a disc groove having disc, wherein disc groove for placement of a customizable disc capable of providing a barrier to the passage of fluids and also allows for displacement of said fluids; said formable hollow cavity comprising an integral set of said bitewings with formable upper and lower surfaces and flanges having upwardly-extending and downwardly-extending flange portions with upper and lower edges, respectively, and providing inside surfaces spaced for formable engagement with opposite side surfaces 30 of said user's teeth, and wherein said formable hollow cavity may or may not contain an elastomeric gel that allows for complete or partial return to an original shape and dimension of said bitewing after said mouthpiece has been used for engagement with said user's teeth by one or more users.

2. The reusable customizable mouthpiece of claim 1, wherein said bitewings-include said formable hollow cavity and said channel allowing for said fluids to flow into and out of said formable hollow cavity, thereby causing a bellows-like process in that said fluid boosts or accelerates recovery of said bitewings to said original shape prior to compression by being allowed to flow back into said formable hollow cavity.

3. The reusable customizable mouthpiece of claim 1, wherein said bitewings of said mouthpiece including said core and said bitewings together are included in a complete mouthpiece, and said core and said bitewings are optionally all of one formable material composition and said formable material composition may optionally be a film or combination of said film and a substrate and is at least 0.1 millimeter thick.

4. The reusable customizable mouthpiece of claim 1, wherein said bitewings of said mouthpiece are of said formable material composition wherein said formable material composition includes a filling material such as said elastomeric gel or gel-like material such as a silicone gel and optionally includes nanoparticles that provide nanocomposites.

5. The reusable customizable mouthpiece of claim 1, wherein said channels are designed to ensure that said channels will retard blockage of said elastomeric gel during compression and release of pressure upon said formable hollow cavity of said bitewings and wherein openings of an end of said channels exists through a lateral wing to said distal outside end of said mouthpiece and an opposite end of said channel exists at an interface between said formable hollow cavity and said channel.

6. The reusable customizable mouthpiece of claim 4, wherein said bitewings of said mouthpiece are of said formable material composition wherein said formable material composition includes said nanocomposites that include SiC and optionally other inorganic particles with an average diameter of 700 nm or less or more depending on the ability of said inorganic particles to provide rebound to improve elastic memory of said bitewings.

7. The reusable customizable mouthpiece of claim 1, wherein said mouthpiece and said bitewings are optionally of said formable material composition optionally including nanoparticles that provide nanocomposites.

8. The reusable customizable mouthpiece of claim 1, wherein said mouthpiece and said bitewings are of said formable material composition wherein said formable material composition includes composites that include organic or inorganic or a combination of organic and inorganic materials including cellular or foamed versions as well as co-polymers, blends, as well as nanocomposites that include inorganics such as clays as well as fullerenes and nanotubes of fullerene based derivatives and essentially any composition with or without nanoparticles that allows complete memory recovery or at least full plastic recovery so that reusability can be achieved.

9. The reusable customizable mouthpiece of claim 1, wherein said formable hollow cavity returns to said original shape upon removal from said user's mouth.

10. The reusable customizable mouthpiece of claim 1, wherein said formable hollow cavity returns to original shape when a recovery temperature, $T_r$, that represents a temperature at which a material recovers said original shape during heating, is reached.

11. The reusable customizable mouthpiece of claim 1, wherein said bitewings are comprised of a material composition that may be initially formed by pressure, by heat and/or by vacuum molding and wherein said bitewings and said composition of said formable hollow cavity is reformable or wherein said elastomeric gel within said hollow cavity of said set of bitewings is reformable.

12. The reusable customizable mouthpiece of claim 1, wherein said bitewings includes a reduction in material requirements for said bitewings along an upper and lower portion of said bitewings that includes a complimenting customizable insert wherein said complimenting customizable insert composition may optionally be a film or combination of said film and a substrate, and wherein said film optionally provides an outer surface of said bitewings over a cellular or foamed formable material composition and said formable hollow cavity may be filled with a silicone gel.

13. The reusable customized mouthpiece as in claim 1, wherein said disc comprises an essentially rigid outer portion and a flexible inner portion so that said disc may act as a diaphragm.

14. A reusable customized mouthpiece as in claim 1, wherein channels are connected to an outer walled section of said mouthpiece that includes "balloon-like" pouches and wherein said pouches exist in an area that is toward a distal outside end of said mouthpiece such that said pouches can never be placed within a mouth portion of a diver.

* * * * *